US005503319A

United States Patent [19]

Lai

[11] Patent Number: 5,503,319

[45] Date of Patent: Apr. 2, 1996

[54] TRANSMISSION MECHANISM FOR AN ELECTRIC STAPLING GUN

[76] Inventor: Wen T. Lai, P.O. Box 82-144, Taipei, Taiwan

[21] Appl. No.: 328,915

[22] Filed: Oct. 25, 1994

[51] Int. Cl.[6] ..... B25C 5/15

[52] U.S. Cl. ..... 227/132; 227/146; 173/203; 74/526

[58] Field of Search ..... 227/129, 131, 227/132, 133, 146; 173/53, 54, 55, 203; 74/25, 526

[56] References Cited

U.S. PATENT DOCUMENTS

| | | | |
|---|---|---|---|
| 4,724,992 | 2/1988 | Ohmori | 227/146 |
| 4,834,278 | 5/1989 | Lin | 227/131 X |
| 5,118,023 | 6/1992 | Fushiya et al. | 227/131 X |

*Primary Examiner*—Richard K. Seidel
*Assistant Examiner*—Jay Stelacone
*Attorney, Agent, or Firm*—Alfred Lei

[57] ABSTRACT

This invention relates to a transmission mechanism for an electric stapling gun and in particular to one including a cam fixedly mounted on an output axle of a gearing of the electric stapling gun and having two lobes such that an angle between the lines joining the two lobes to the center is less than 180 degrees. The transmission mechanism also has a hammer movably mounted in a groove formed in front portion of the electric gun and having a U-shaped member with an open end towards the cam, whereby when the cam is rotated, one pin of the cam will urge the U-shaped member of the hammer to compress a spring and then the other pin of the cam will urge the hammer in succession to further compress the spring.

1 Claim, 5 Drawing Sheets

TRANSMISSION MECHANISM FOR AN ELECTRIC STAPLING GUN

BACKGROUND OF THE INVENTION

It is found that the conventional electric stapling gun utilizes a cam to urge a hammer to compress a spring which will then force the hammer to hit a staple by its restoring force. As we know, the ideal electric stapling gun should be energy saving, strong in hitting force and compact in size. However, in order to provide stronger hitting force, the conventional electric stapler uses a cam with a longer distance between the center and the lobe so as to increase the compression of the spring and this will require more driving power and increase the size as well. In short, the electric stapling gun will consume more power and have a larger size.

It is, therefore, an object of the present invention to provide a transmission mechanism for an electric stapling gun which may obviate and mitigate the above-mentioned drawbacks.

SUMMARY OF THE INVENTION

This invention relates to a transmission mechanism for an electric stapling gun.

It is the primary object of the present invention to provide a transmission mechanism for an electric stapling gun which is energy saving.

It is another object of the present invention to provide a transmission mechanism for an electric stapler gun which is compact in size.

It is another object of the present invention to provide a transmission mechanism for an electric stapling gun which is simple in construction.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 2:
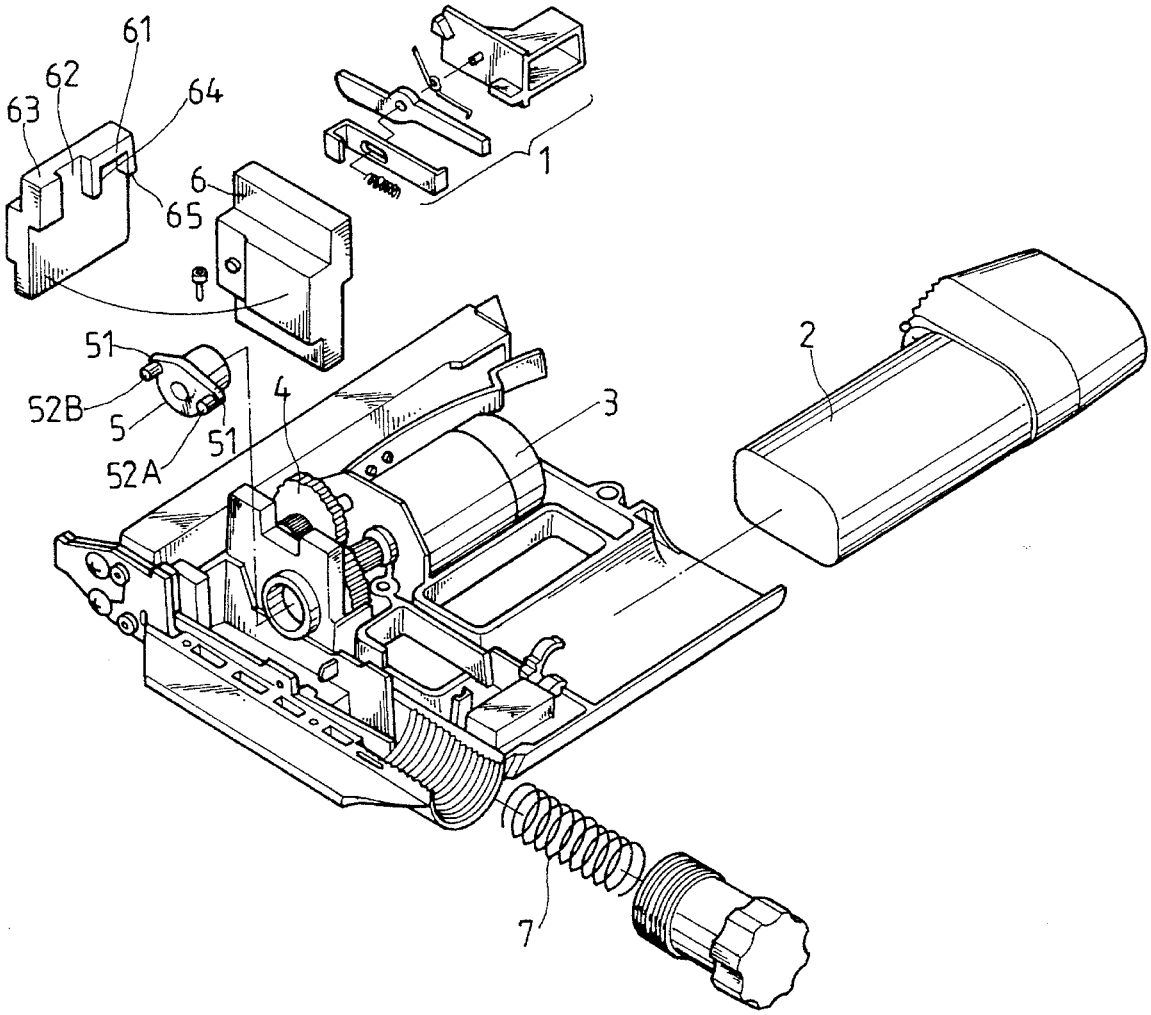
FIG. 2 is an exploded view of the transmission mechanism for the electric stapler.
Figure 3:
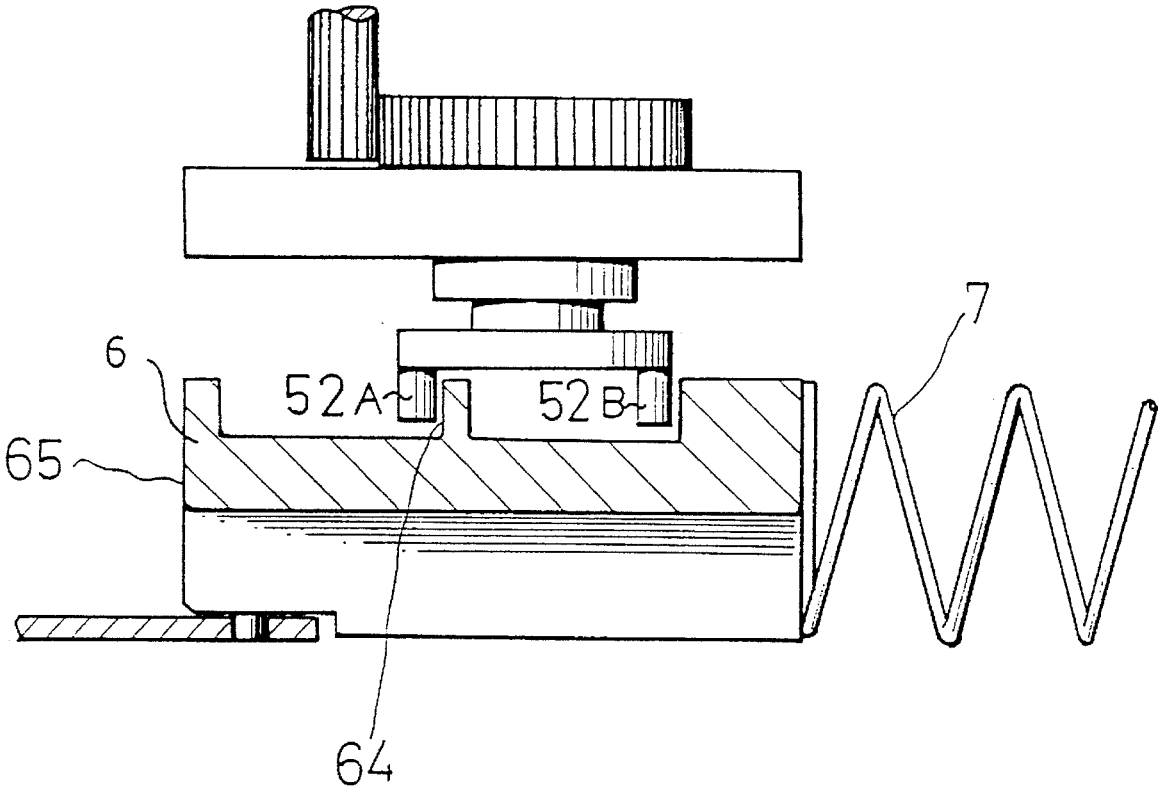
FIG. 3 shows the relationship among the component parts of the transmission mechanism for the electric stapling gun.

With reference to the drawings and in particular to FIG. 2 thereof, the transmission mechanism for an electric stapling gun according to the present invention mainly comprises a cam 5 and a hammer 6. The cam 5 is provided with two lobes 51 on which are mounted two pins 52A and 52B. The angle formed between the lines linking the two lobes 51 with the center of the cam 5 is slightly less than 180 degrees so as to prevent dead point. Further, the cam 5 is fixedly connected with the output axle of a gearing 4.

Figure 1:
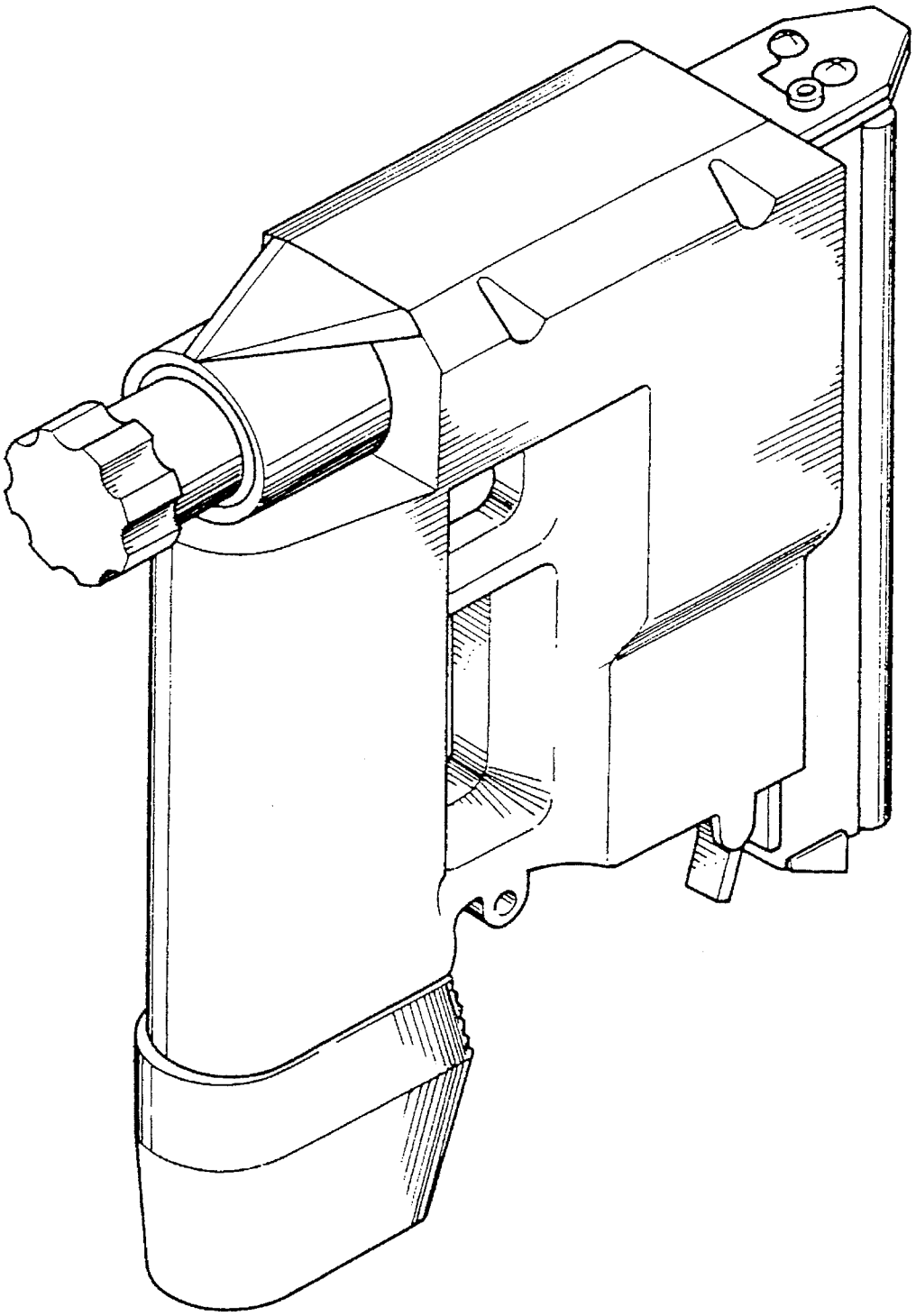
FIG. 1 is a perspective view of a transmission mechanism for an electric stapling gun according to the present invention.
Figure 4A:
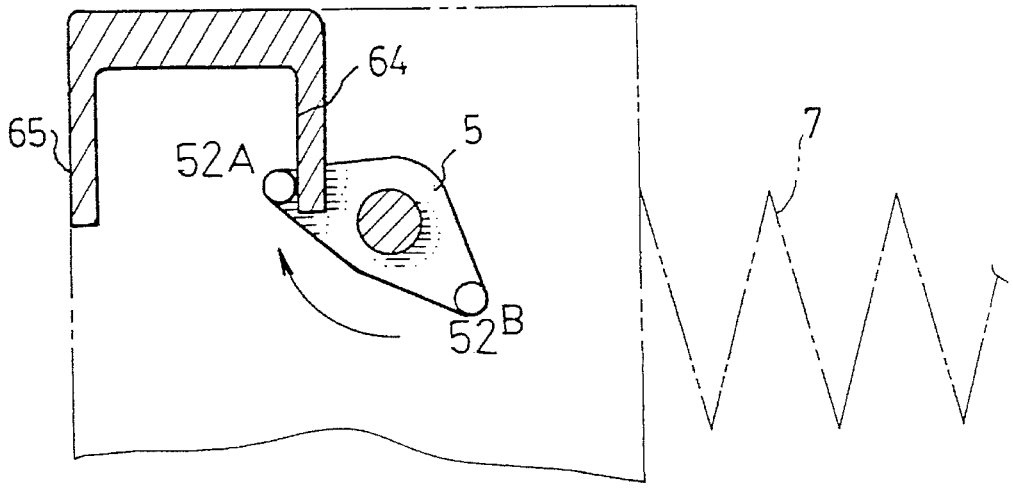
FIGS. 4A, 4B, 4C and 4D shows the principle of the transmission mechanism for the electric stapling gun.

The hammer 6 is movably mounted on a groove formed on the front portion of the electric stapling gun and can be moved leftwards and rightwards with respect to FIG. 1. Further, the hammer 6 is formed at the left part of its inner side with a U-shaped member 61, at the middle part of its inner side with a recess 62, and at the right part of its inner side with a protuberance 63. The distance between the inner right side and the outer left side of the U-shaped member 61 is less than that between the two lobes 51. Moreover, the hammer 6 is located outside the cam 5, with one pin 52A normally disposed between two arms of the U-shaped member 61 and the other pin 52B disposed behind the former pin 52A, as is shown in FIG. 4A.

Figure 4B:
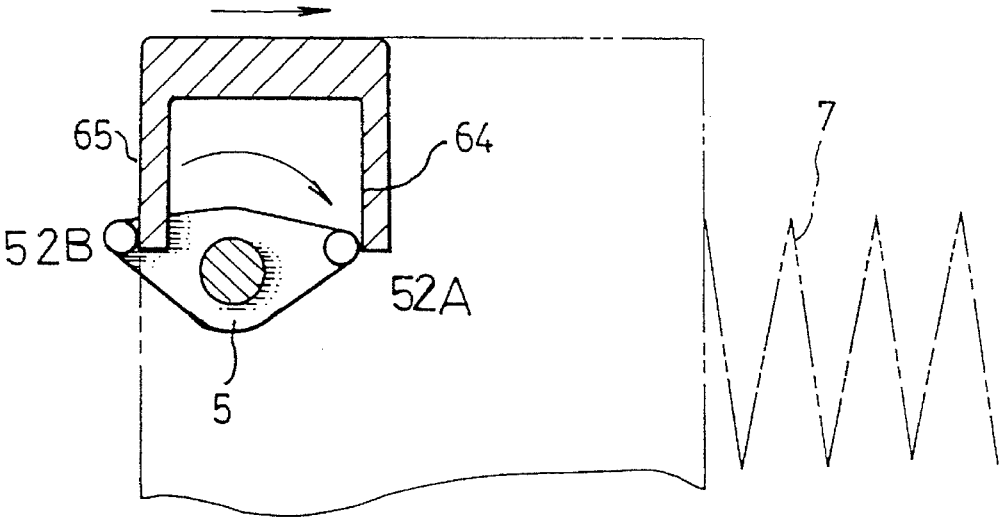
Figure 4C:
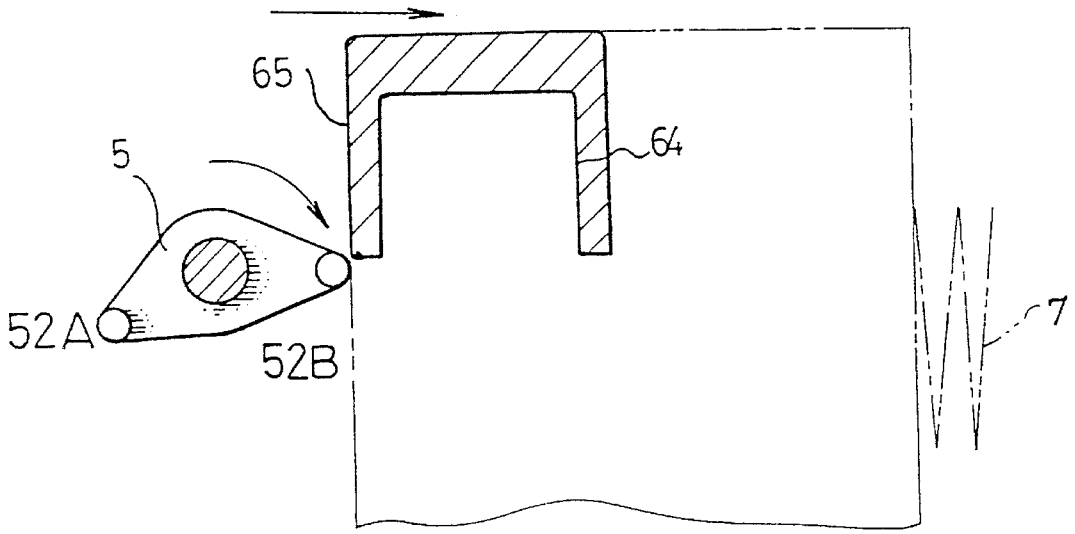
Figure 4D:
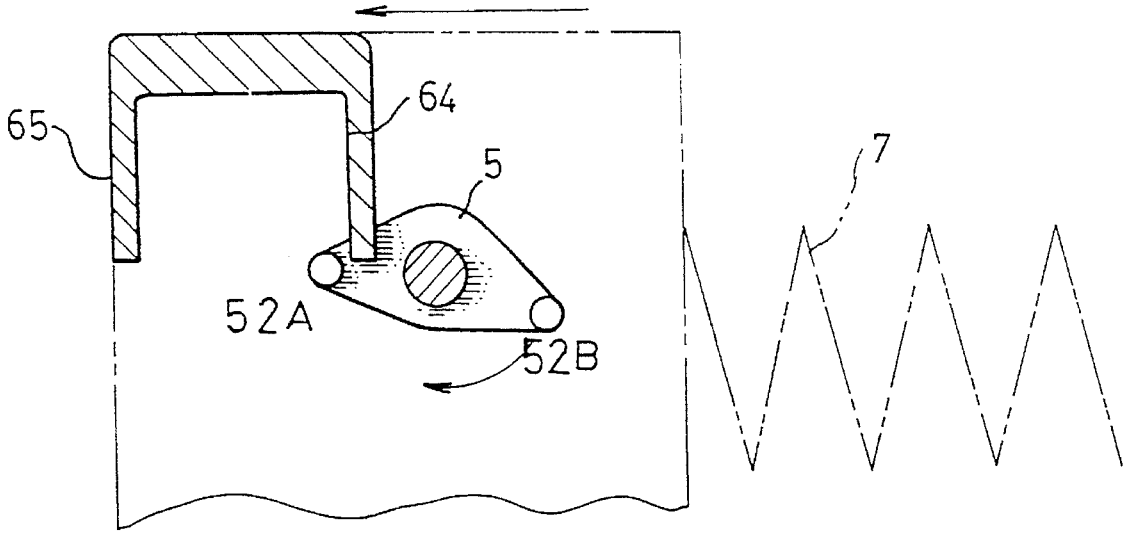

When in use, first press the trigger 1 to start the motor 3 which drives the gearing 4 so that the output axle of the gearing 4 rotates the cam 5. Thus, the pin 52A will urge the inner right side 64 of the U-shaped member 61 to move rightwards thereby compressing the spring 7 (see FIG. 4A). As the cam 5 continues to rotate, the other pin 52B will force the top left side of the U-shaped member 61 to go rightwards thus further compressing the spring 7 (see FIG. 4B and 4C). Then, the cam 5 is separated from the U-shaped member 61 and the compressed spring 7 will restore to force the U-shaped member 61 to move the hammer 6 towards the left (see FIG. 4D) thereby hitting out the staple.

In view of the above description, the present invention has the following advantages:

1. Since the two pins 52A and 52B of the cam 5 will urge the U-shaped member 61 of the hammer 6 in succession, the compression of the spring 7 will be approximately equal to 1.8 times the compression of the prior art. As a result, the restoration is relatively enlarged thus increasing the force exerted on the staple by the hammer 6.

2. When utilizing the structure of the prior art to increase 1.8 times of the compression, it is necessary to use a cam with 1.8 times the distance from the center to the edge of the lobe of the prior art. However, the longer the distance is, the larger the required torque will be necessary to push the hammer to compress the spring. That is to say, the load of motor is increased and more power is consumed. Hence, in comparison with the prior art, the present invention may provide the same hitting effect with less power consumption.

3. Further, the cam of the present invention is smaller in size thereby increasing flexibility.

Although the present invention has been described with a certain degree of particularity, it is understood that the present disclosure is made by way of example only and that numerous changes in the construction and the combination and arrangement of parts may be resorted to without departing from the spirit and scope of the invention as hereinafter claimed.

I claim:

1. A transmission mechanism for an electric stapling gun comprising:

a cam fixedly mounted on an output axle of a gearing of said electric stapling gun and having two lobes such that an angle between lines joining said two lobes to a center is less than 180 degrees, each lobe being provided with a pin thereon; and a hammer movably mounted in a groove formed in a front portion of said electric stapling gun, said hammer having a U-shaped member at a left part of one side thereof, a recess at an intermediate part of said side, and a protuberance at a right part of said side, said U-shaped member having an open end toward said cam and having an inner side at one end and an outer side at a second end which are separated by a distance smaller or equal to a distance between said two lobes of said cam;

whereby when said cam is rotated, one pin of said cam will urge said U-shaped member of said hammer to compress a spring and then a second pin of said cam will urge said hammer in succession to further compress said spring thereby achieving objects to save energy, to provide stronger hitting force and to reduce size.

* * * * *